US012529276B2

(12) United States Patent
Hansen et al.

(10) Patent No.: US 12,529,276 B2
(45) Date of Patent: Jan. 20, 2026

(54) WELL INTERVENTION TOOL AND METHOD FOR CLEARING TUBES AND LINES

(71) Applicant: Axter AS, Bryne (NO)

(72) Inventors: Henning Hansen, Sirevåg (NO); Tarald Gudmestad, Nærbø (NO); Torfinn Bjelland, Lye (NO); Arnulf Bye, Kverneland (NO)

(73) Assignee: Axter AS, Bryne (NO)

( * ) Notice: Subject to any disclaimer, the term of this patent is extended or adjusted under 35 U.S.C. 154(b) by 0 days.

(21) Appl. No.: 18/811,769

(22) Filed: Aug. 22, 2024

(65) Prior Publication Data

US 2025/0043646 A1 Feb. 6, 2025

Related U.S. Application Data

(63) Continuation of application No. PCT/IB2023/051624, filed on Feb. 22, 2023.

(60) Provisional application No. 63/312,485, filed on Feb. 22, 2022.

(51) Int. Cl.
*E21B 29/00* (2006.01)

(52) U.S. Cl.
CPC ..... *E21B 29/007* (2013.01)

(58) Field of Classification Search
CPC ..... E21B 29/007; E21B 31/18; E21B 29/04
See application file for complete search history.

(56) References Cited

U.S. PATENT DOCUMENTS

| | | | | | |
|---|---|---|---|---|---|
| 1,194,461 | A * | 8/1916 | Zahniser | ..... | E21B 29/04 166/54.6 |
| 3,926,252 | A * | 12/1975 | Ribeyre | ..... | E21B 29/04 114/221 A |
| 4,512,411 | A * | 4/1985 | Pringle | ..... | E21B 29/04 166/55.3 |
| 2008/0092356 | A1 | 4/2008 | Fuhst et al. | | |
| 2008/0236828 | A1 | 10/2008 | Fuhst et al. | | |

(Continued)

FOREIGN PATENT DOCUMENTS

| | | | | |
|---|---|---|---|---|
| EP | 1241321 A2 | 9/2002 | | |
| WO | WO-0188330 A1 * | 11/2001 | ..... | E21B 29/04 |

(Continued)

OTHER PUBLICATIONS

International Search Report and Written Opinion, International Application No. PCT/IB2023/051624 issued May 16, 2023.

*Primary Examiner* — James G Sayre
(74) *Attorney, Agent, or Firm* — Richard A. Fagin

(57) ABSTRACT

A method for locating and retrieving a line, tube or conduit ("line") disposed in a well includes moving an intervention tool into a part of the well wherein the line is accessible to the tool when the tool is conveyed into the well from within a first tubular string. A first gripper arm is rotated in a first direction around an inner circumference of the first tubular string by operating a first motor in the tool until the first gripper arm contacts the line. A second gripper arm is rotated in a second direction opposed to the first direction around the inner circumference until the second gripper arm contacts the line by operating the first motor in a same direction as for rotating the first gripper arm. The first gripper arm and the second gripped arm are retracted to move the line toward the intervention tool.

15 Claims, 7 Drawing Sheets

(56) References Cited

U.S. PATENT DOCUMENTS

2011/0290487 A1* 12/2011 Perschke ..... E21B 29/007
166/55
2014/0033885 A1 2/2014 Karsten et al.

FOREIGN PATENT DOCUMENTS

WO WO-2020144521 A1 * 7/2020
WO WO-2024084208 A1 * 4/2024 ..... E21B 23/01

* cited by examiner

WELL INTERVENTION TOOL AND METHOD FOR CLEARING TUBES AND LINES

CROSS REFERENCE TO RELATED APPLICATIONS

Continuation of International Application No. PCT/IB2023/051624 filed on Feb. 22, 2023. Priority is claimed from U.S. Provisional application Ser. No. 63/312,485 filed on Feb. 22, 2022.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of wellbore intervention tools. More particularly, the disclosure relates to well intervention tools and methods used to, among other things, clear parts of a well of lines, conduits, cables and tubes. Clearing may be used for plugging and abandonment, for recovery for reuse of well construction positions ("slots") on a marine or other well template and cable or small tube recovery ("fishing") operations.

Plugging and abandonment of subsurface wells used for extraction of hydrocarbons are undertaken when the wells no longer produce economically useful amounts of hydrocarbons. Plugging and abandoning requires ensuring hydraulic integrity of the wellbore, in particular, tubular strings such as casing and tubing, such that fluid leakage out of the well or into susceptible subsurface formations is avoided. Once hydraulic integrity is proven in a well, certain equipment at the surface end of the well, e.g., a valve assembly ("Christmas tree"), and associated pressure control devices ("blowout preventers") may be removed from the well for reconditioning and reuse, or for salvage. The value of such equipment may be considerable, and as a result there is economic incentive to be able to plug and abandon wells in a manner that enables safe removal of such equipment.

It happens from time to time that hydraulic integrity of a well cannot be established because a tubular string in the well, e.g., production tubing (nested within the well casing) has failed such as by become axially separated, for example, when corrosion stress cracking causes tubing failure at one or more threaded connections in a "string" of jointed (segments engaged end to end by threads) tubing. Operations to establish hydraulic integrity in such circumstances, such as providing an inflatable seal (plug) through the upper end of the severed tubular string may not be useful by reason of lines, tubes, conduits or cables being disposed in an annular space between the tubing and the casing.

FIG. 1 illustrates an example of the foregoing failure of a tubing string in a marine (subsea) well. The well 10 may comprise a casing 24 disposed in the drilled subsurface formations (the "wellbore") to a selected depth to protect the formations, maintain mechanical integrity of the wellbore and to hydraulically isolate the formations from each other and from the environment outside the well 10. A tubular string, such as a production tubing 14 may be nested within the casing 24 to provide a smaller cross-sectional area flow path for produced fluids than does the casing 24 to provide sufficient flow velocity to the upper end of the well of the produced fluids. External lines, tubes, cables or conduits, e.g., as shown at 16 and 18 may comprise, for example, an hydraulic line 16 to operate devices deeper in the well 10 such as a downhole safety valve (not shown) and an electrical cable 18, shown severed in FIG. 1), to operate sensors, controls and other electrically powered and/or control devices in the well 10, such as an electrical submersible pump (not shown). In the example shown in FIG. 1, the tubing failed, leaving a lower portion 14A terminating in a space A, and an upper portion 14B suspended in a tubing hanger 12 part of a wellhead (not shown).

The parted tubing 14, leaving the space shown by reference numeral A could, in the absence of lines or tubes, be sealed using a through tubing plug such as an inflatable plug, thus establishing hydraulic integrity within the well 10. However, the presence of the hydraulic line 16 makes impossible the use of such plug. While conventional well intervention procedures using a workover rig, coiled tubing unit or similar device are available to enable removing the upper portion 14B of the tubing 14 and subsequent sealing of the casing 24, such procedures can be expensive, time consuming and can expose personnel to risk of unintended discharge of fluid under pressure from the well ("blowout") when the intervention procedure takes place.

Other well conditions requiring specific intervention include a cable, such as wire rope or wound-armor electrical cable that has become partially unwound and may need to be removed from the well. Unwinding of a wire rope or cable in a well may result in development of an enlarged feature called a "birdcage", having an irregular diameter, and/or separated-strand faults in the wire rope or cable. Capture and retrieval of a wire rope or cable having birdcage features using conventional cable retrieval ("fishing") tools and methods is ordinarily difficult and failure prone.

What is needed is an apparatus to enable through-tubing intervention to retrieve and sever lines and tubes disposed in the annular space, wherein such tools may be conveyed through the severed tubular string without the need to remove the severed tubular string. What is also needed is a wellbore intervention tool that can improve results of cable fishing operations.

SUMMARY

One aspect of the present disclosure is a method for locating and retrieving a line, tube or conduit disposed in a well. A method according to this aspect includes moving an intervention tool into a part of the well wherein the line, tube or conduit is accessible to the tool when the tool is conveyed into the well from within a first tubular string. A first gripper arm is rotated in a first direction around an inner circumference of the first tubular string by operating a first motor in the tool until the first gripper arm contacts the line, tube or conduit A second gripper arm is rotated in a second direction opposed to the first direction around the inner circumference until the second gripper arm contacts the line, tube or conduit by operating the first motor in a same direction as for rotating the first gripper arm. The first gripper arm and the second gripped arm are retracted to move the line, tube or conduit toward the intervention tool.

In some embodiments, a cutting wheel in the first intervention tool is operated to sever the line, tube or conduit when the line, tube or conduit is retracted against the intervention tool.

In some embodiments, the cutting wheel is rotated by a second motor in the intervention tool.

In some embodiments, the rotating the second gripper arm comprises continuing to apply rotational motion to the first gripper arm after the first gripper arm contacts the line, tube or conduit, wherein the intervention tool rotates in a direction opposed to the applied rotational motion.

In some embodiments, prior to rotating the first gripper arm, the first gripper arm is retracted against the intervention tool, and operating the first motor initially causes extension of the first gripper arm.

In some embodiments, prior to rotating the second gripper arm, the second gripper arm is retracted against the intervention tool, and rotating the second gripper arm after the first gripper arm contacts the line, tube or conduit initially causes extension of the second gripper arm.

A well intervention tool according to another aspect of the present disclosure includes a tool mandrel having an axis. At least two hook-shaped gripper arms are pivotally coupled to the tool mandrel to enable lateral extension from the tool mandrel when the arms are rotated. A first motor is disposed in the tool mandrel and is rotationally coupled so that a pivot for one of the at least two arms is rotatable about the axis. A first gear ring is rotatable about the axis and is rotationally coupled to the one of the at least two arms by gear teeth. A second gear ring is rotatable about the axis and is rotationally coupled to another one of the at least two arms by gear teeth. A clutch having a predetermined slip torque rotationally couples the first gear ring and the second gear ring.

Some embodiments further comprise a second motor disposed in the tool mandrel and is rotatably coupled to a cutting wheel, the cutting wheel disposed at least partially in the tool mandrel. In some embodiments, the clutch comprises a disk clutch.

Some embodiments further comprise a swivel connecting the tool mandrel to a conveyance.

In some embodiments, the conveyance comprises one of an electrical cable, a slickline, a coiled tubing or a jointed tubing.

In some embodiments, a pivot on which another of the at least two gripper arms is mounted is in a rotationally fixed position with reference to the tool mandrel.

Other aspects and possible advantages will be apparent from the description and claims that follow.

DETAILED DESCRIPTION

Figure 1:
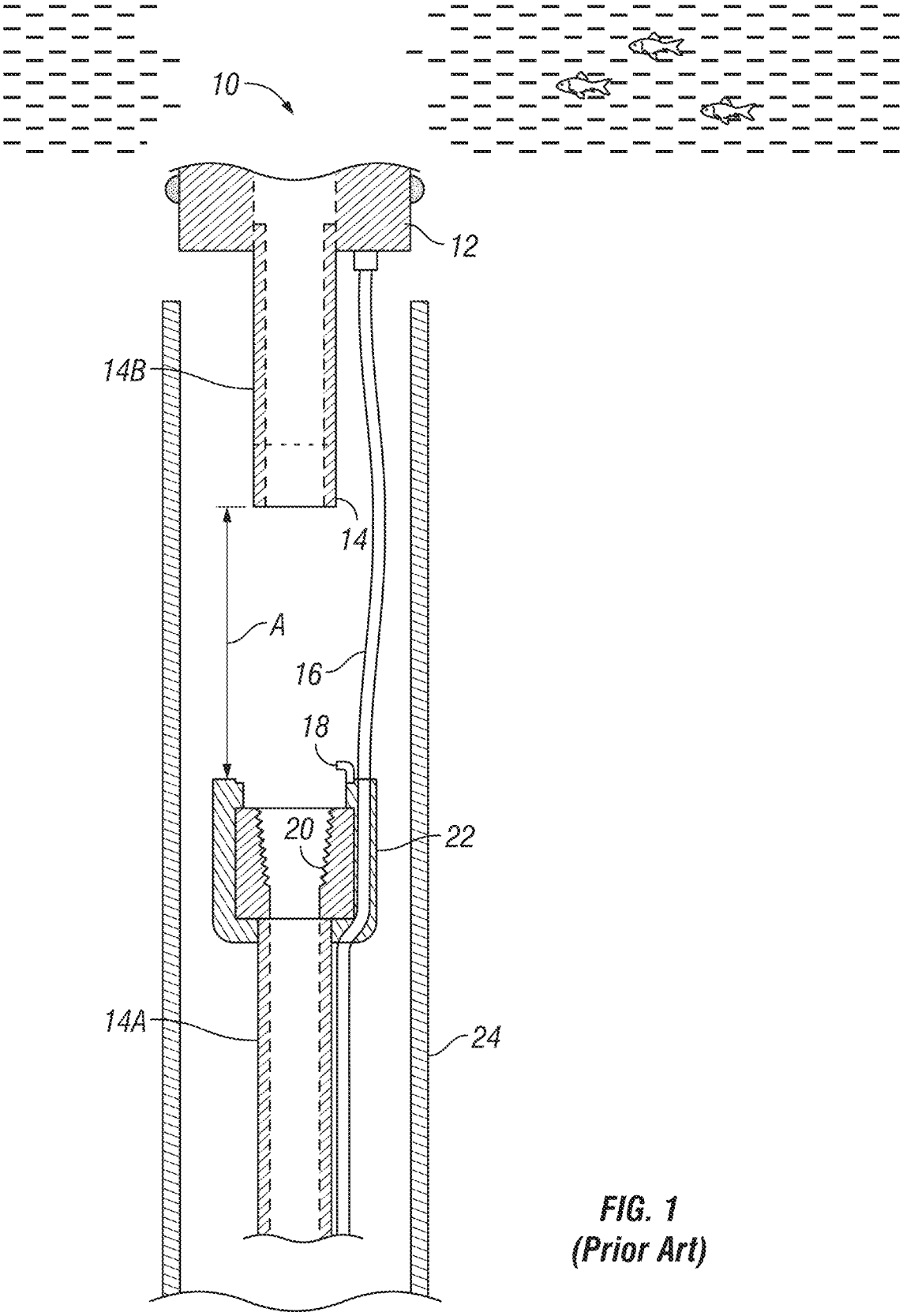
FIG. 1 (Prior Art)
FIG. 1 shows a subsurface well having a separated tubing string nested within a casing, and at least one intact control line, cable or the like in the annular space between the tubing and the casing.

An example embodiment of a well intervention tool (hereinafter the "tool") is shown in oblique view in FIG. 2 identified by numeral 200. The tool 200 may comprise a tool mandrel 202 that may be connected to and conveyed along a subsurface well, e.g., such as shown in FIG. 1, by an armored electrical cable, slickline, coiled tubing or jointed tubing. The tool 200 may be coupled any such conveyance by a connector 216 having features, not shown separately, to make the necessary connections. In some embodiments, the connector 216 may comprise a swivel, not shown separately, to enable the tool 200 to rotate relative to the conveyance to facilitate operation of the tool 200.

The mandrel 202 may comprise an upper mandrel 203, in which may be disposed one or more components to operate certain devices on the tool 200 to be explained further below with reference to FIG. 6. The upper mandrel 203 may be connected to a lower mandrel 204 by a mandrel extension (202A in FIG. 3), upon which may be located a thrust collar 206A against which a gripper arm base 206 is free to rotate about the mandrel extension (see 202A in FIG. 3). The lower mandrel 204 may terminate at one longitudinal end in a guide nose (or "bullnose") 208 to facilitate movement of the tool 200 axially along the interior of a subsurface well (e.g., as shown in FIG. 1).

A lower limit detector 212 may extend from the lower mandrel 204, e.g., by spring pressure, so as to provide indication when the tool 200 has exited the upper portion (see 14B in FIG. 1) of a separated tubing string and into a space (see A in FIG. 1) and to provide indication when and if the tool 200 makes contact with or enters the lower portion (see 14A in FIG. 1) or such separated tubing string.

The tool 200 is shown in FIG. 1 having contacted, latched onto and withdrawn proximate to the mandrel 202 an external line, tube, conduit or cable 16 as explained with reference to FIG. 1 for cutting. Cutting and removing a segment of the external line, tube, conduit or cable 16 ("external line" hereinafter for convenience) will be explained further below.

An upper limit detector 214 may extend from the upper mandrel 203 to indicate when the tool 200 has reached or started to enter the upper portion (14B in FIG. 1) to enable retrieving and making a cut in the external line 16 so as to enable removal of a segment thereof from the space (A in FIG. 1).

The general principle of operation of elements in the tool that locate and grip an external line may be operated by a single motor, e.g., a rotary motor such as an electric motor, using the principle of the differential, and in some instances a limited slip differential. A single rotational input may drive two separate rotating elements, e.g., gripper arms, in opposed relative directions until one rotating element is stopped from further rotation by a limit, barrier or obstruction. When the one element is thus stopped from rotation, continued rotation of the motor through suitable linkage and/or gearing causes the other rotating element to continue to rotate in the opposed direction relative to the stopped rotating element. The rotating elements, e.g., gripper arms may be radially extended such that a hook-like feature on each such gripper arm is ultimately caused to contact the external line. Hook features on the gripper arms are thus caused to surround the external line and subsequently draw it toward the tool housing for cutting by, e.g., a rotary cutting wheel.

In some embodiments, a single motor may drive relative motion between the two gripper arms by placing the motor in one of the gripper arms, and driving the other gripper arm. A different configuration may be to have two gripper arms placed rotatably around a third member, where the third member has a drive motor to rotate the two gripper arms to contra-rotate relative to each other and independent of the position of the third member by the use of a differential driving the two gripper arms. Each gripper arm may be driven by one of the two outputs from the differential. The differential may also have limited slip features.

The present example embodiment of using a tool as described herein to locate and retrieve an external line is explained with reference to a line, tube, cable or conduit that is disposed in an annular space between nested well tubular strings, specifically where the inner string of the nested tubular strings may be severed or separated to expose the annular space to a tool moved into the well from within the inner tubular string. However, the scope of the present disclosure is not limited to use of the described intervention tool in such circumstances. An intervention tool according to the present disclosure may be used to locate and retrieve any form of line, tube, conduit or cable disposed in a well where such line is disposed within a bore in the well that may be circumferentially traversed by gripper arms on the intervention tool. As explained in the Background section herein, a non-limiting example of such line in a well comprises a cable or wire rope that has become partially unwound, and/or may be frayed and therefore needs to be removed from the well. Unwinding and/or fraying of a wire rope or cable in a well may result in development of a "birdcage", or irregular diameter, separated-strand fault in the wire rope or cable. Capture and retrieval of birdcage features using conventional cable retrieval ("fishing") tools and techniques is ordinarily difficult and failure prone, and may be substantially facilitated using an intervention tool according to the present disclosure.

Having explained the general principle of a tool according to the present disclosure, the example embodiment herein intended to perform the above-described functions will now be explained beginning with reference to FIG. 3. An upper gear ring 303 is rotatably disposed on the mandrel extension 202A generally thrust-facing against a shoulder 203A on the bottom of the upper mandrel 203. The upper gear ring 303 comprises gear teeth 303A meshed with corresponding teeth 302B on an upper gripping arm 302. The upper gripping arm 302 is pivotally coupled to a fixed pivot 302A. The fixed pivot 302A is coupled to the upper mandrel 203. Thus the fixed pivot 302A is rotationally fixed to the upper mandrel 203. When the upper gear ring 303 rotates with reference to the upper mandrel 203, the teeth 303B move so as to cause rotation of the upper gripping arm 302 about the fixed pivot 302A and thereby to rotate either radially outwardly or radially inwardly, depending on the direction of rotation. The upper gripping arm 302 may be generally arcuate shaped, so that when it is radially retraced against the mandrel extension 202A, the upper gripping arm 302 does not present a substantially larger diameter feature than the upper mandrel 203, so as to facilitate movement of the tool (200 in FIG. 2) along the well. A free end of the upper gripping arm 302, opposed to the end having the teeth 302B, may comprise a generally hook shaped end or feature 302H adapted to contact and restrain the external line (16 in FIG. 2) when the upper gripping arm 302 is radially extended and is rotated against the external line (16 in FIG. 2).

A lower gear ring 305 may be rotatably disposed on the mandrel extension 202A longitudinally adjacent to the upper gear ring 303 and may have gear teeth 305B similar in structure to the gear teeth 303A on the upper gear ring 303. A friction disk, disk pack or other form of clutch 306 may be disposed longitudinally between the upper gear ring 303 and the lower gear ring 305, such that rotation imparted to the lower gear ring 305, explained further below, will be imparted to the upper gear ring 303 until a predetermined torque is reached, after which the upper gear ring 303 may rotate with reference to the lower gear ring 305. A biasing device such as a spring (explained further below) may exert axial thrust to cause the lower gear ring 305 to compress the clutch 306 against the upper gear ring 303 to provide the foregoing torque transmitting feature.

Figure 2:
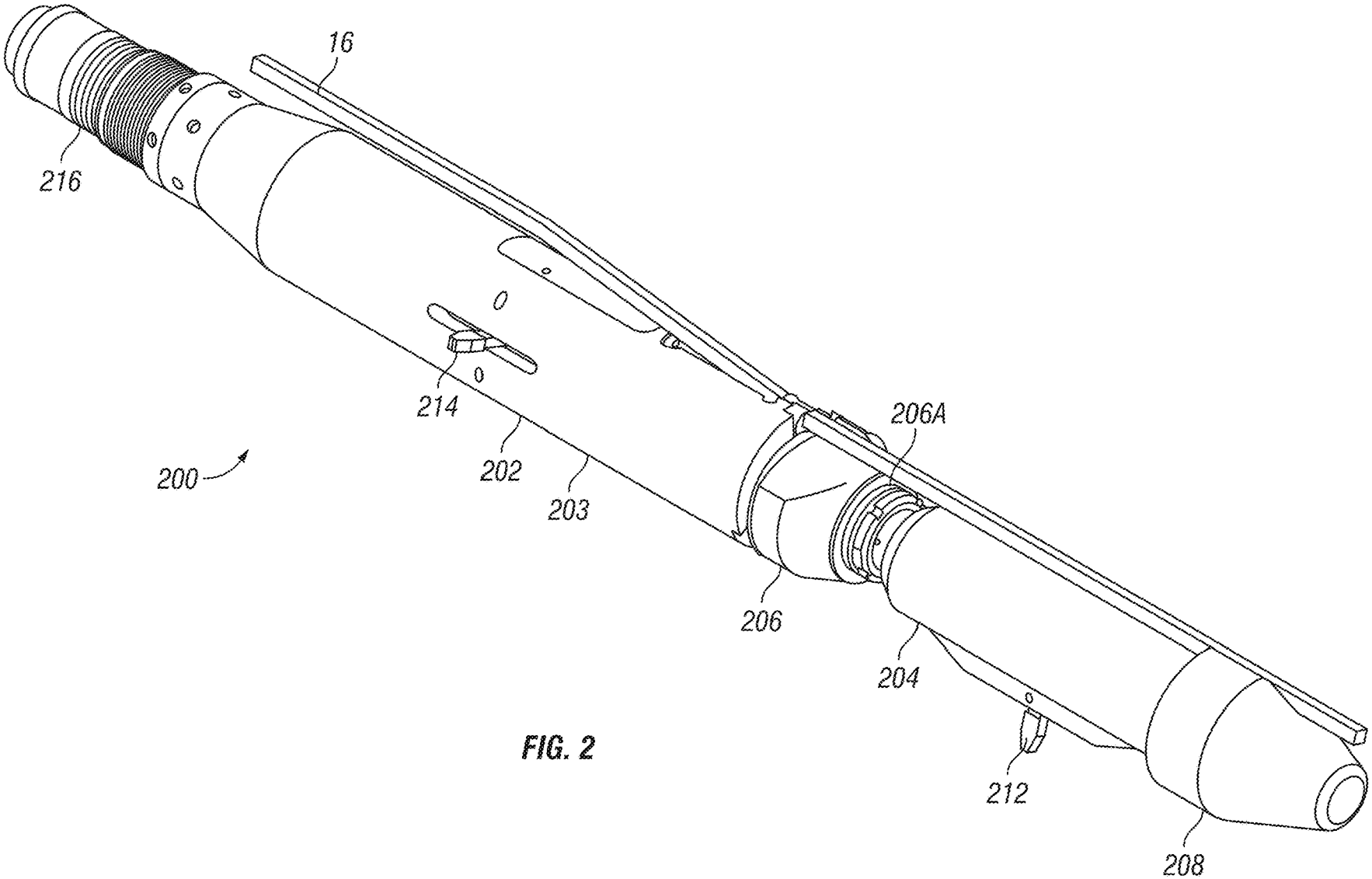
FIG. 2 shows an oblique view of an example embodiment of a well intervention tool according to the present disclosure.
Figure 3:
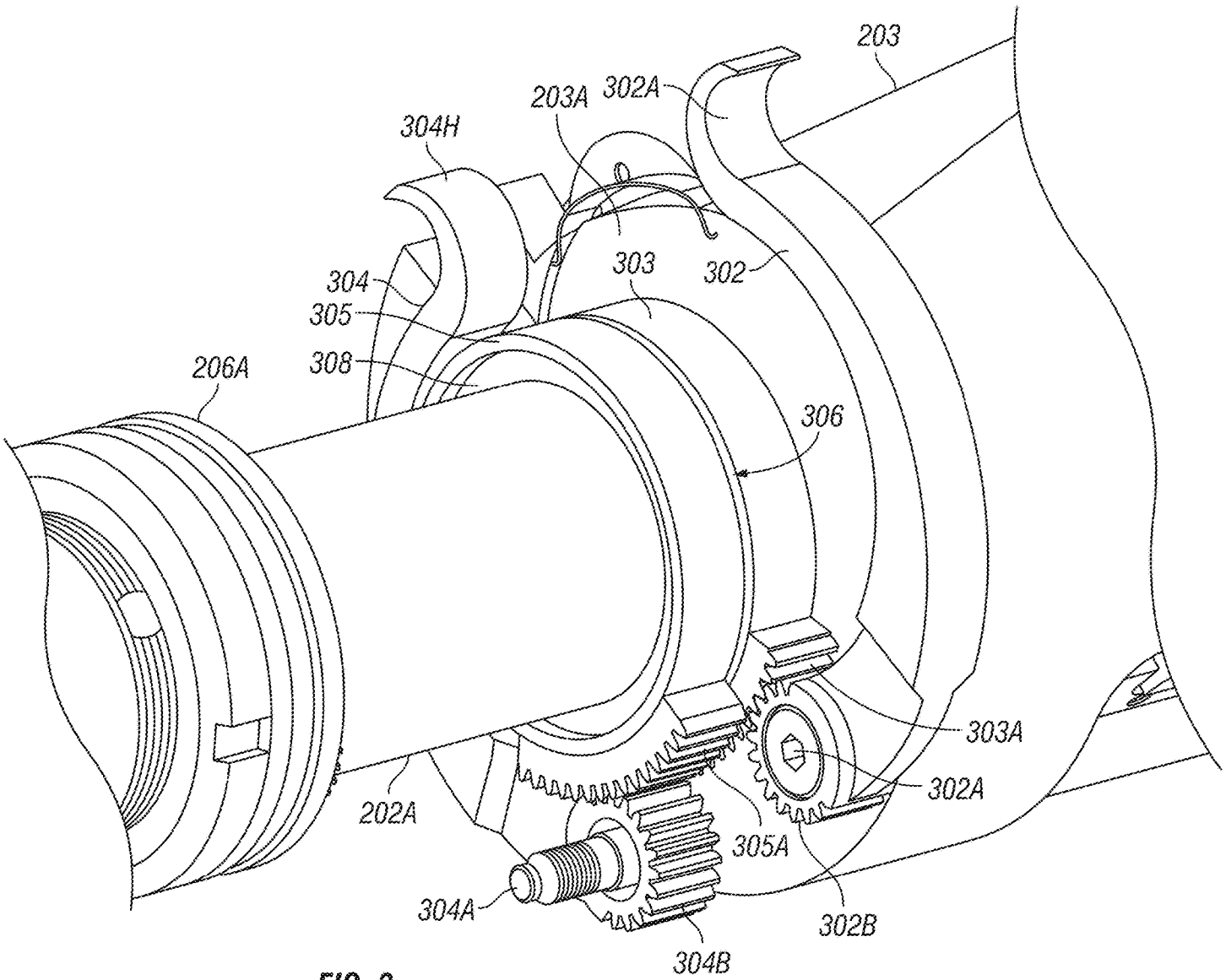
FIG. 3 shows a partial, exploded view of drive components to operate gripping arms in the example tool of FIG. 2.
Figure 7:
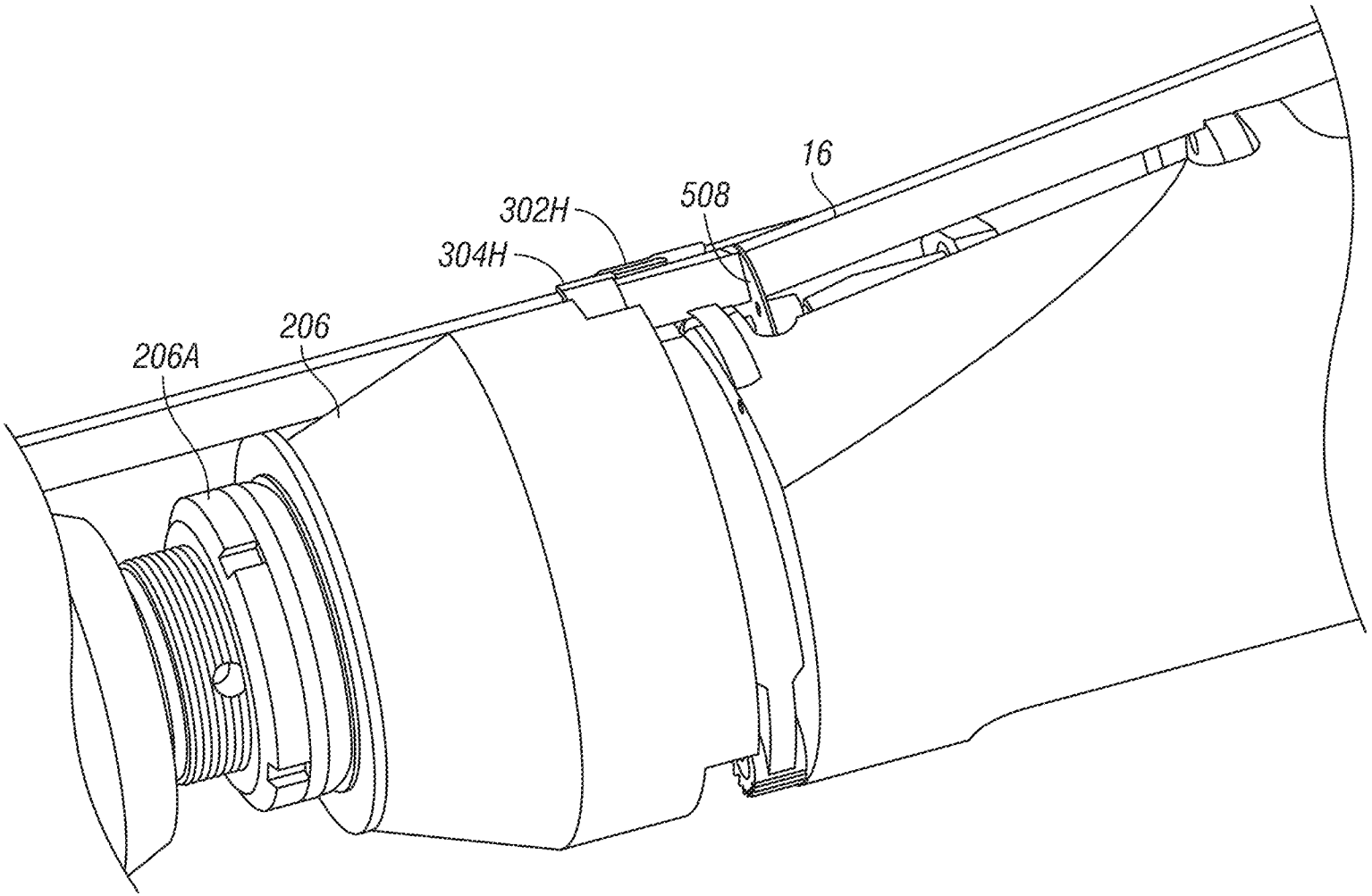
FIG. 7 shows an oblique view corresponding to the view of FIG. 3, with a gripper base installed on the tool.

A lower gripping arm 304 may be pivotally coupled to the gripper arm base (not shown in FIG. 3, see 206 in FIG. 2) by a pivot 304A that is inserted into a corresponding opening in the gripper arm base (206 in FIG. 2). The lower griping arm 304 may also be generally arcuate shaped, may be oriented to have its arc substantially opposed to the arc orientation of the upper gripping arm 302 and may comprise at one end a hook shaped end 304H to contact and retrieve the external line (16 in FIG. 2). The lower gripping arm 304 may also comprise teeth 304B that engage and cooperate with the teeth 305A on the lower gear ring 305 to cause radial rotation, i.e., extension or retraction, of the lower gripping arm 304. The lower gear ring 305 may comprise a thrust face 308 to transfer axial force, such as may be provided by a spring (not shown) acting against the thrust collar 206A to urge the lower gear ring 305 against the clutch 306, and the clutch 306 against the upper gear ring 303, such that until the above-described torque limit is reached, the lower gear ring 305 and the upper gear ring 303 rotate together. A different view of a corresponding part of the tool with the gripper base 206 present and the gripping arms 304, 302 clamped about the external line 16 is shown in FIG. 7.

Figure 4:
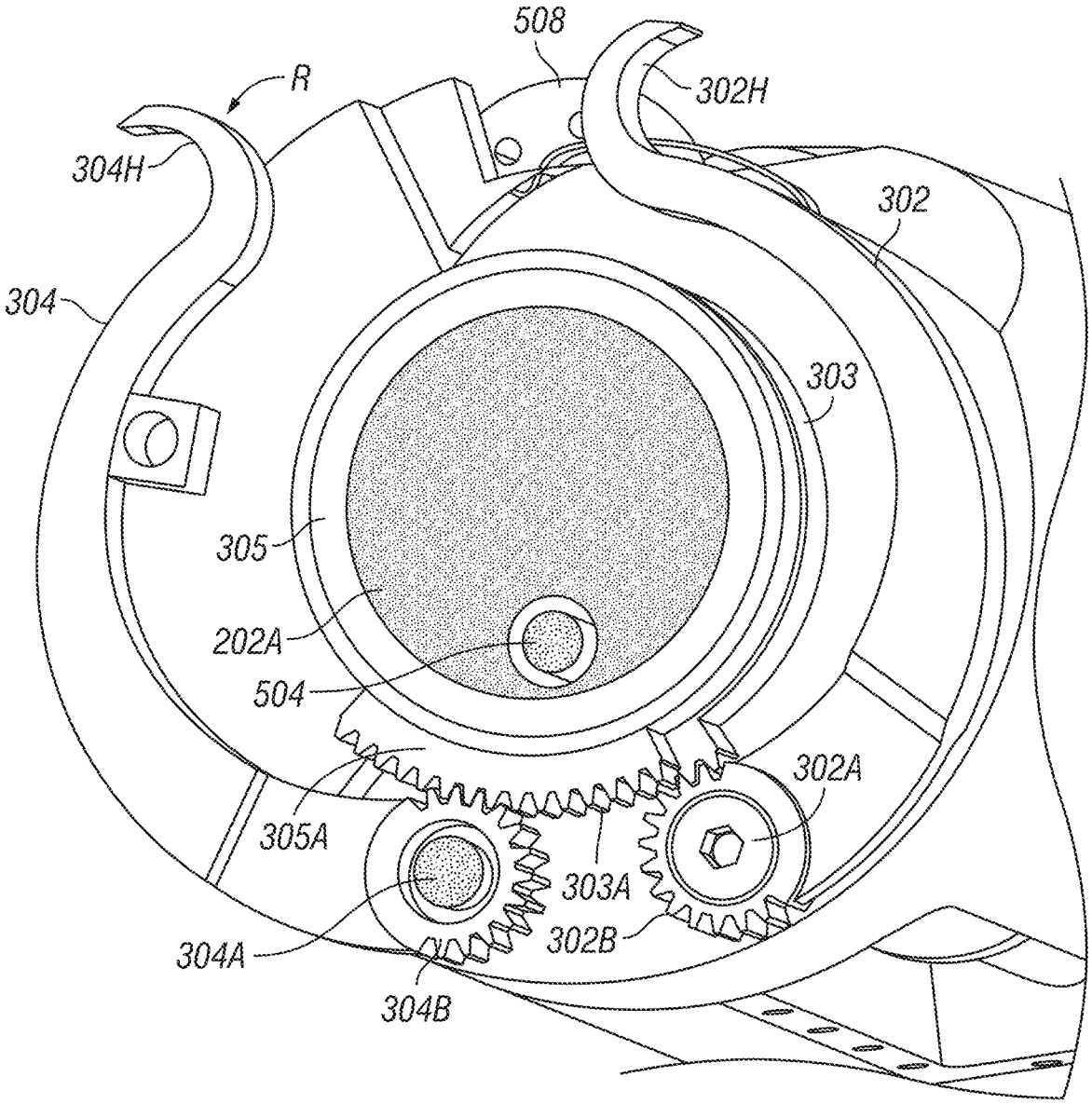
FIG. 4 shows a cross-section view of part of the example tool of FIG. 2.

The foregoing components are also shown in cross-sectional view in FIG. 4, which also shows a driveshaft 504 that may be used to transfer rotation from a motor (see FIG. 6) to the gripper arm base (206 in FIG. 2).

In operation, once the tool (200 in FIG. 2) is positioned at a chosen depth in the well (FIG. 1), a motor (see FIG. 6) may be started or switched on to rotate the driveshaft 504. The driveshaft 504 may be gear coupled (see FIG. 6) to the gripper arm base (206 in FIG. 2), which itself then rotates on the mandrel extension 202A. For purposes of the present explanation, rotation of the gripper arm base (206 in FIG. 2) may be clockwise (CW) viewed from above the plane of FIG. 3 and FIG. 4. It will be appreciated by those skilled in the art that reverse rotation direction may be implemented to equal effect with suitable reversal of orientation of the components shown in FIGS. 3 and 4.

Rotation of the gripper arm base (206 in FIG. 2) in the CW direction causes corresponding rotation of the lower gripping arm pivot 304 in the same (CW) direction, indicated as the direction of rotation shown at R. At the same time, the lower gear ring 305 is temporarily rotationally fixed to the mandrel (202 in FIG. 2) by reason of the clutch 306 rotationally coupling the lower gear ring 305 to the upper gear ring 303, and because of the direction of rotation R, engagement of the teeth 303A on the lower gear ring 303 with the teeth 302B on the upper gear ring 303 to the upper gripping arm 302 and the upper gripping arm 302 will try to extend outwards from the mandrel (202), but assumed to be temporarily prevented from this due to more friction through all gears and bearings than the simple movement of the lower gripper arm around its pivot (304A). Therefore, the lower gear ring 305 is (within the torque limit of friction and the clutch 306) rotationally fixed to the upper mandrel 203. In this way, the lower gripping arm 304 is caused to rotate in a clockwise (CW) direction to extend radially outwardly from the mandrel extension 202A until it reaches an external limit, which is generally the well casing (24 in FIG. 1) when the tool is operated within a well casing or other well tubular.

When further rotation of the lower gripping arm 304 about the pivot 304A is stopped by the lower gripping arm 304 reaching such external limit (e.g., the casing 24), the lower gripping arm 304 is prevented from further rotation about the lower gripping arm pivot 304A. Further rotation of the gripper arm base (206 in FIG. 2), to which the lower gripping arm pivot 304A is fixedly attached, thereby results in the teeth 304B on the lower gripping arm 304 causing corresponding rotation of the lower gear ring 305, in a clockwise (CW) direction. Such rotation of the lower gear ring 305 is transferred to the upper gear ring 303 by the clutch 306. Rotation of the upper gear ring 303 then causes about-pivot (pivot 302A) rotation of the upper gripping arm 302 in a CCW direction, thereby causing the upper gripping arm 302 to extend laterally from the mandrel 203 until the upper gripping arm 302, also reaches a radial extension limit, e.g., the casing (24 in FIG. 1). From that point on, the lower gripping arm 304 moves in its entirety, extended laterally against the limit (e.g., the casing 24), in a CW direction with reference to the upper mandrel 203 by reason of the pivot 304A being rotated by the gripper arm base (206 in FIG. 2). Thus, while the upper gripping arm 302 is being radially extended, the lower gripping arm 304 is being caused to "sweep" the inner surface of the casing (24 in FIG. 1) in a CW direction.

When the upper gripping arm 302 is fully radially extended, e.g., into contact with the limit (e.g., casing 24 in FIG. 1), rotation of the upper gripping arm 302 about the pivot 302A will stop and the upper gear ring 303 will stop rotation commensurately. Continued rotation of the lower gear ring 305 as explained above, will eventually cause the applied torque to the clutch 306 to exceed the clutch's torque limit, such that circumferential rotation of the lower gripping arm 304 and its pivot 304A continues with respect to the mandrel, e.g., the upper mandrel 203. That is, the lower gripping arm 304 will sweep the wall of the casing (24 in FIG. 1) until it contacts the external line (16 in FIG. 1) in the hook 304H while both gripper arms will exert a radial force on the ID of the casing as a function of the clutch slipping torque and the gearing between the gear rings and the gripper arms. Once such contact takes place, further rotation of the lower gripping arm 304 with reference to the casing is stopped, and the entire tool (200 in FIG. 1) with the rotationally fixed upper gripping arm 302 rotates in the opposed direction (CCW) until its hook 302H contacts the external line (16 in FIG. 1). The hooks 302H and 304H thereby enclose and capture the external line (16 in FIG. 1) between them.

Figure 5:
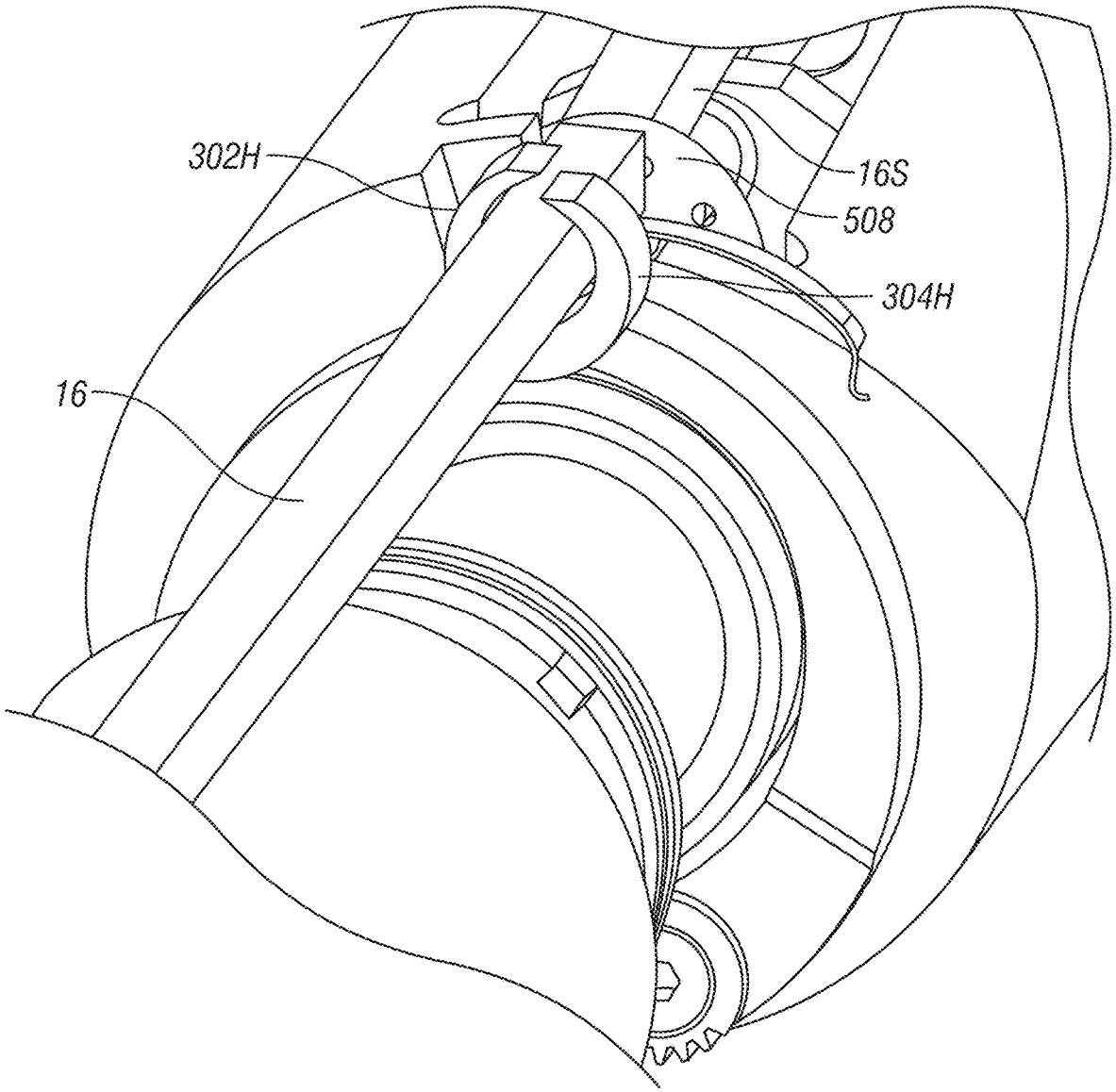
FIG. 5 shows the example tool of FIG. 2, wherein the external line or cable, such as in FIG. 1, has been captured by the gripping arms of FIG. 2, and withdrawn toward the tool housing for cutting by a cutting device such as a rotary cutting wheel.

After both the upper gripping arm 302 and the lower gripping arm 304 have contacted the external line 16, continued rotation of the gripper arm base 206 in the same direction causes the following actions to take place. The clutch 306 limit torque will be reached and will then slip. When the clutch 306 slips, each gear-ring 303, 305 will follow the rotation of respective pivot 302A, 304A. That is, the lower gripping arm pivot 304A will rotate along with the gripper arm base 206 relative to the tool axis, and the upper gripping arm pivot 302A will be rotationally fixed with reference to the tool mandrel 203. Thus, the upper gripping arm 302 is rotated in the opposed direction with reference to the lower gripping arm 304 about toll axis. The gripping arms 302, 304 will then be retracted to their parked positions while they continue to overcome the clutch slipping torque, and force the corresponding gear rings 303, 305 to counter-rotate. The two pivots 302A, 304A at such time act in the manner of a crank, and pull the respective gripping arm 302, 304 laterally inward toward the tool mandrel 203 because the gripping arms 302, 304 cannot continue to sweep the casing (24 in FIG. 1); the captured external line 16 prevents further sweep rotation. Given that the external line 16 will not allow gripping arm rotation around the tool axis, continued rotation of the gripper arm base 206 will force the two gripping arms 302, 304 and pivots 302A, 304A to move with same speed in opposite directions, and the external line 16 will thereby be pulled radially inwards, toward the fully retracted position. During such retraction, the external line 16 may be drawn across the cutting wheel (coming into the path of the cutting wheel at an angle due to the relative rotation of the mandrel 203). Withdrawal of the external line 16 into the mandrel 202 and thereby into the cutting wheel 508 is shown in FIG. 5, wherein may be observed the unsevered portion 16S of the external line 16 above the cutting wheel 508. A possible advantage of withdrawing the external line 16 into the cutting wheel 508 is eliminating any need for a mechanism to radially extend the cutting wheel 508 from the mandrel 202, thus simplifying the design of the tool (200 in FIG. 2). After cutting the external line 16, if it is desired, it is possible to release the external line 16 from the gripping arms 302, 304. Such release may be obtained by reversing rotation of the motor to cause corresponding rotation of the gripper arm base 206. Such reversed rotation will move the two gripping arms 302, 304 rotationally away from the external line 16, and such rotation will also continue to urge the gripping arms 302, 304 in the retract direction further due to the relative motion of the gear rings 303, 305 and the clutch 306. Since the gripping arms 302, 304 are already in their retracted positions, they cannot retract more (except for possible clearances in the system), and the clutch 306 will almost immediately start slipping. The external line 16 will thus be released from the gripping arms 302, 304. The foregoing operation of the tool may be repeated while the tool is in the well as will be further explained below.

To improve functionality of the intervention tool 10, in some embodiments, one or more sensors may be included to indicate when the external line 16 has been contacted by the lower gripping arm 304 and the upper gripping arm 302. For example, a motor current sensor may make measurements corresponding to the torque generated by the motor (FIG. 6). Indications of contacting the external line 16 may correspond to step-wise increases in motor torque. Such sensors may comprise, for example, electric current sensors.

In preparing a well for insertion of a plug into the space (A in FIG. 1), the external line 16 may be severed as shown in FIG. 5, the gripping arms 302, 304 once again extended to release the severed external line 16, and the tool moved upwardly in the well to once again contact, enclose and retract the external line 16 for cutting at a second, shallower position along the well. After the external line 16 is cut at the second position, rotation of the gripper arm base (206 in FIG. 2) may be stopped so that the severed segment of the external line 16 remains trapped between the gripping arms 302, 304. The tool may then be withdrawn from the well, along with it the severed section of the external line 16. A plug or other device may then be run into the well into the space (A in FIG. 1) for further intervention.

Figure 6:
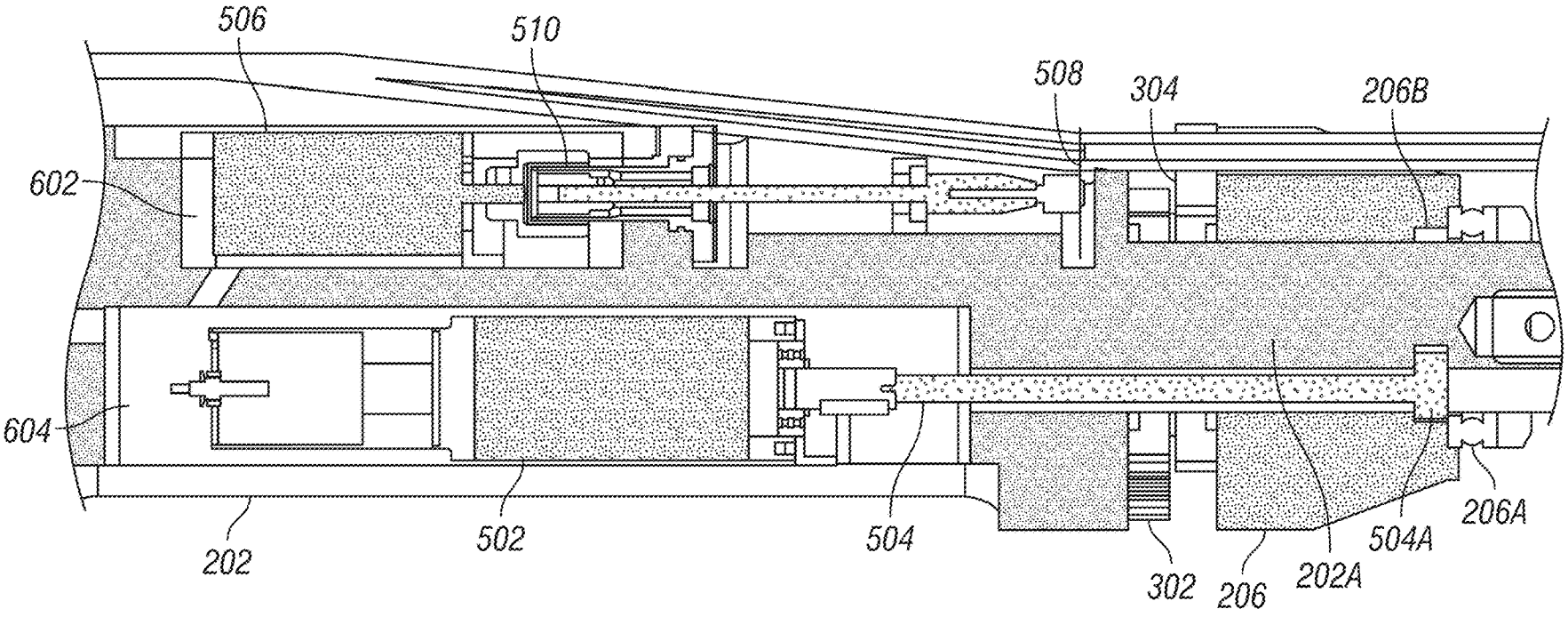
FIG. 6 shows a cross-sectional view of the example tool of FIG. 1 to illustrate example embodiments of motors to drive the gripping arms and cutting wheel.

FIG. 6 shows a cross sectional view of the embodiment explained with reference to FIGS. 2 through 5 to show some of the components not previously explained in detail. The mandrel 202 may define interior chambers 602 and 604 which may be partially or completely sealed to exclude any fluids under pressure outside the mandrel 202 from entering such chambers. A lower chamber 604, "lower" only meaning with reference to the drawing and not to any required position within the mandrel 202, may contain a first motor 502 such as an electric motor, rotatably coupled at its output to a driveshaft 504. The driveshaft 504 may have at its longitudinal end a gear 504A such as a spur gear that rotatably engages a corresponding toothed inner circumference 206B located at one longitudinal end of the gripper arm base 206 to cause rotation thereof when the first motor 502 is operated. The first motor 502 may be relatively low speed, e.g., on the order of tens to a few hundreds of RPM, thereby making practical many forms of rotating seal, such as O-rings or stuffing boxes.

An upper chamber 602, "upper" again being only with reference to the drawing and not to a required position of the chamber, may contain a second motor 506, which may be an electric motor. Rotary output of the second motor may be coupled through a magnetic clutch 510 to ultimately drive the cutting wheel 508. The magnetic clutch 510 may make more practical completely pressure sealing the upper chamber 602 without the need to any form of rotary seal. Such arrangement may make practical the use of a high speed motor, e.g., 10,000 RPM to drive the cutting wheel 508.

A well intervention tool according to the present disclosure may enable cutting external lines, tubes, conduits and cables ordinarily disposed in an annular space between nested tubular strings in a well, where a space is opened by reason of separation of an inner nested string. Such cutting may be performed advantageously without the need to anchor the tool in the well, and without the need to detect the orientation or position of the external lines, tubes, conduits and cables. Further, operation of gripping and retrieving features on the tool may be performed with only one motor. Still further, operation of a cutting wheel on the tool, and related operation of the gripping and retrieving features on the tool enables locating and cutting such lines, cables, conduits and tubes without the need to any mechanism to extend the cutting device, e.g., the wheel, laterally from the main housing of the tool. The foregoing capabilities substantially simplify the design of the intervention tool, may increase reliability and reduce required maintenance costs.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for locating and retrieving a line, tube or conduit disposed in a well, the method comprising:

moving an intervention tool into a part of the well wherein the line, tube or conduit is accessible to the tool when the tool is conveyed into the well from within a first tubular string;

rotating a first gripper arm in a first direction around an inner circumference of the first tubular string by operating a first motor in the tool until the first gripper arm contacts the line, tube or conduit;

rotating a second gripper arm in a second direction opposed to the first direction around the inner circumference until the second gripper arm contacts the line, tube or conduit by operating the first motor in a same direction as for rotating the first gripper arm; and retracting the first gripper arm and the second gripped arm to move the line, tube or conduit toward the intervention tool.

2. The method of claim 1 further comprising operating a cutting wheel in the first intervention tool to sever the line, tube or conduit when the line, tube or conduit is retracted against the intervention tool.

3. The method of claim 1 wherein the cutting wheel is rotated by a second motor in the intervention tool.

4. The method of claim 1 wherein the rotating the second gripper arm comprises continuing to apply rotational motion to the first gripper arm after the first gripper arm contacts the line, tube or conduit, wherein the intervention tool rotates in a direction opposed to rotational motion applied to the first gripper arm.

5. The method of claim 1 wherein prior to rotating the first gripper arm, the first gripper arm is retracted against the intervention tool, and operating the first motor initially causes extension of the first gripper arm.

6. The method of claim 5 wherein prior to rotating the second gripper arm, the second gripper arm is retracted against the intervention tool, and rotating the second gripper arm after the first gripper arm contacts the line, tube or conduit initially causes extension of the second gripper arm.

7. The method of claim 1 further comprising reversing rotation of the first motor to rotate the first gripper arm and the second gripper arm away from the line, tube or conduit.

8. The method of claim 1 wherein the line, tube or conduit is disposed in an annular space between the first tubular string and a second tubular string, wherein the second tubular string is nested within the firsts tubular string and the annular space is accessible by the tool when the tool is conveyed into the well through the second tubular string.

9. The method of claim 1 further comprising:

operating a cutting wheel in the first intervention tool to sever the line, tube or conduit when the line, tube or conduit is retracted against the intervention tool;

releasing the severed line, tube or conduit from the first gripper arm and the second gripper arm;

moving the intervention tool to a shallower depth in the well;

repeating the rotating the first gripper arm, rotating the second gripper arm, retracting the first and second gripped arms and operating the cutting wheel on the line, tube or conduit at the shallower depth; and removing the intervention tool with the severed line, tube or conduit retained by the first gripper arm and the second gripper arm.

10. A well intervention tool, comprising:

a tool mandrel having an axis;

at least two hook-shaped gripper arms pivotally coupled to the tool mandrel to enable lateral extension from the tool mandrel when the arms are rotated;

a first motor disposed in the tool mandrel and rotationally coupled to a pivot for one of the at least two arms so that the pivot is rotatable about the axis;

a first gear ring rotatable about the axis and rotationally coupled to the one of the at least two arms by gear teeth;

a second gear ring rotatable about the axis and rotationally coupled to another one of the at least two arms by gear teeth; and a clutch having a predetermined slip torque rotationally coupling the first gear ring and the second gear ring.

11. The tool of claim 10 further comprising a second motor disposed in the tool mandrel rotatably coupled to a cutting wheel, the cutting wheel disposed at least partially in the tool mandrel.

12. The tool of claim 10 wherein the clutch comprises a disk clutch.

13. The tool of claim 10 further comprising a swivel connecting the tool mandrel to a conveyance.

14. The tool of claim 13 wherein the conveyance comprises one of an electrical cable, a slickline, a coiled tubing or a jointed tubing.

15. The tool of claim 10 wherein a pivot on which the another of the at least two gripper arms is mounted is in a rotationally fixed position with reference to the tool mandrel.

* * * * *